US006547262B1

(12) United States Patent
Yamada et al.

(10) Patent No.: US 6,547,262 B1
(45) Date of Patent: Apr. 15, 2003

(54) SKATEBOARD TRUCK ASSEMBLY

(75) Inventors: Toshihiro Yamada, Nagoya (JP); Takayuki Hiranuma, Fujisawa (JP)

(73) Assignee: Unicomm Corporation, Nagoya (JP)

( * ) Notice: Subject to any disclaimer, the term of this patent is extended or adjusted under 35 U.S.C. 154(b) by 0 days.

(21) Appl. No.: 09/629,571

(22) Filed: Jul. 31, 2000

(30) Foreign Application Priority Data

Aug. 31, 1999 (JP) ..... 11-245683

(51) Int. Cl.[7] ..... A63C 17/02
(52) U.S. Cl. ..... 280/11.28; 280/87.042
(58) Field of Search ..... 280/11.27, 11.28, 280/11.23, 11.25, 87.042, 87.041; 267/292, 293; 16/2.1, 2.2, 2.3, 2.4, 2.5, 35 D, 44; 411/544, 542

(56) References Cited

U.S. PATENT DOCUMENTS

| | | | | | |
|---|---|---|---|---|---|
| 218,035 | A | * | 7/1879 | Lash | 280/11.28 |
| 2,373,220 | A | * | 4/1945 | Blaes | 280/11.27 |
| 2,429,678 | A | * | 10/1947 | Fuller | 280/11.28 |
| 2,606,768 | A | * | 8/1952 | Wagner | 280/11.28 |
| 2,719,725 | A | * | 10/1955 | Ware | 280/11.28 |
| 3,027,680 | A | * | 4/1962 | Gallagher, Jr. | 16/44 |
| 3,642,268 | A | * | 2/1972 | Hipsher | 16/21 |
| 3,870,324 | A | * | 3/1975 | Balstad | 280/11.28 |
| 4,109,925 | A | | 8/1978 | Williams et al. | |
| 4,159,830 | A | * | 7/1979 | Solimine | 280/11.28 |
| 4,166,629 | A | * | 9/1979 | List | 280/87.042 |
| 4,185,847 | A | * | 1/1980 | Johnson | 280/87.042 |
| 4,194,752 | A | | 3/1980 | Tilch et al. | |
| 4,245,848 | A | | 1/1981 | Dudouyt | |
| 4,463,412 | A | | 7/1984 | Broach | |
| 4,930,794 | A | * | 6/1990 | Chan | 280/11.28 |
| 5,069,586 | A | * | 12/1991 | Casey | 16/21 |
| 5,118,122 | A | * | 6/1992 | Ricart | 280/87.042 |
| 5,347,681 | A | | 9/1994 | Wattron et al. | |
| 5,947,326 | A | * | 9/1999 | O'Hern et al. | 16/21 |
| 6,056,302 | A | * | 5/2000 | Smith | 280/11.28 |
| 6,182,987 | B1 | * | 2/2001 | Bryant | 280/11.28 |

FOREIGN PATENT DOCUMENTS

| | | |
|---|---|---|
| FR | 2586619 | 3/1987 |

OTHER PUBLICATIONS

Copy of the Fury Truck Co. Brochure Fury USA, PO Box 13080, Long Beach, CA 90803.

* cited by examiner

*Primary Examiner*—Brian L. Johnson
*Assistant Examiner*—Christopher Bottorff

(57) ABSTRACT

The present invention relates generally to an improved skateboard truck for skateboards. The preferred skateboard truck comprises a yoke mounted by a king bolt to a mounting base. The mounting base comprises a socket hub and a bracket. The yoke comprises a hanger and a pivot arm. The pivot arm rotates freely in a bearing unit supporting the pivot arm in the socket hub. The king bolt clamps the hanger with a first grommet and a second grommet. The first grommet is flexible, preferably made of urethane rubber, and comprises an edge circumference and a center circumference. The center circumference is narrower than the edge circumference. Preferably, the first and second grommets are fluorescent.

22 Claims, 15 Drawing Sheets

SKATEBOARD TRUCK ASSEMBLY

BACKGROUND OF THE INVENTION

1. Technical Field

The present invention relates generally to an improved truck assembly for skateboards and street luges and more particularly to provide speed and fast reaction maneuverability.

2. Background Art

Skateboards have gained wide acceptance for recreational and sport activities. Competitions in skateboards have included downhill skateboard racing and slalom courses. Since the participants travel at relatively high speeds and require quick maneuverability in turns, the performance of the truck assembly is important. Additionally, such truck assemblies can also be utilized in street luges.

A prior art skateboard and trucks are shown in FIGS. 11 through 14. FIG. 11 is a perspective view that shows an assembled skateboard. FIG. 12 is a front view of a prior art truck. FIG. 13 is a side view of the prior art truck. FIG. 14 is an expanded cross-sectional view of a prior art truck with a skateboard attached.

Generally, a skateboard comprises a board 1 and a set of wheels 2 that are attached to a bottom surface of the board 1. The wheels 2 are attached to the board using trucks 3. A truck 3 is mounted to the bottom surface of the board 1 by a mounting base 21 that comprises a socket hub 15 and a bracket 13. The mounting base 21 is generally mounted to the board 1 by bolts and nuts at mounting holes 17. The truck 3 comprises a right and left wheel axle 4 that extend perpendicularly to a side of the board 1 and the direction of the skateboard's travel. Each wheel axle 4 is mounted through a yoke 6 and affixed with an axle nut 5.

The yoke 6 comprises a pivot arm 14 that is connected to the mounting base 21 at the socket hub 15. The pivot arm 14 is inserted into a rubber bushing mount 16, usually urethane, in a pivot hole 15*a* in the socket hub 15.

The connection of the pivot arm 14 to the mounting base 21 at the socket hub 15 by using the rubber bushing 16 is usually done to reduce damage to the board 1 from vibration and positional change from any up and down motion of the yoke 6 during use. However, in a prior art truck, significant frictional forces can occur between the pivot arm 14 and the rubber busing 16 and between the pivot hole 15*a* and the rubber busing 16 when the board 1 inclines right or left during maneuvering, and in particular during slalom riding. The pivot arm 14 of the prior art skateboard truck may not rotate smoothly and therefore can reduce maneuverability.

The yoke 6 further comprises a hanger 7 that is flexibly clamped by an upper grommet 8 and a lower grommet 9. A king bolt 10 passes through the lower grommet 9, the hanger 7 and the upper grommet 8 at the bolt holes 9*a*, 7*a* and 8*a* respectively and into the bracket 13 at bolt hole 13*a*. The king bolt 10 is affixed by a nut 11 and washer 12.

The upper grommet 8 is generally shaped as a large, thick circular pillar. Though this structure absorbs impact, it may cause the wheel axle 4 to resist right or left movements when the user shifts his/her weight and may further reduce operating performance by hindering rotation of the wheel axle 4.

Thus, an improved skateboard truck is needed that allows for smoother pivot arm rotation associated with the right or left incline of the skateboard and increased operating performance of the wheel axis during such maneuvers.

SUMMARY OF THE INVENTION

The present invention relates generally to an improved skateboard truck for skateboards and luges. The preferred skateboard truck comprises a yoke mounted by a king bolt to a mounting base. The mounting base comprises a socket hub and a bracket. The yoke comprises a hanger and a pivot arm. The pivot arm can rotate freely in a ball bearing unit that supports the pivot arm in the socket hub. The king bolt clamps the hanger between a first grommet and a second grommet. The first grommet is flexible, preferably made of urethane rubber, and can comprise an edge circumference and a center circumference. The center circumference is narrower than the edge circumference. Preferably, the first and second grommets are fluorescent.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved skateboard truck.

Figure 1:
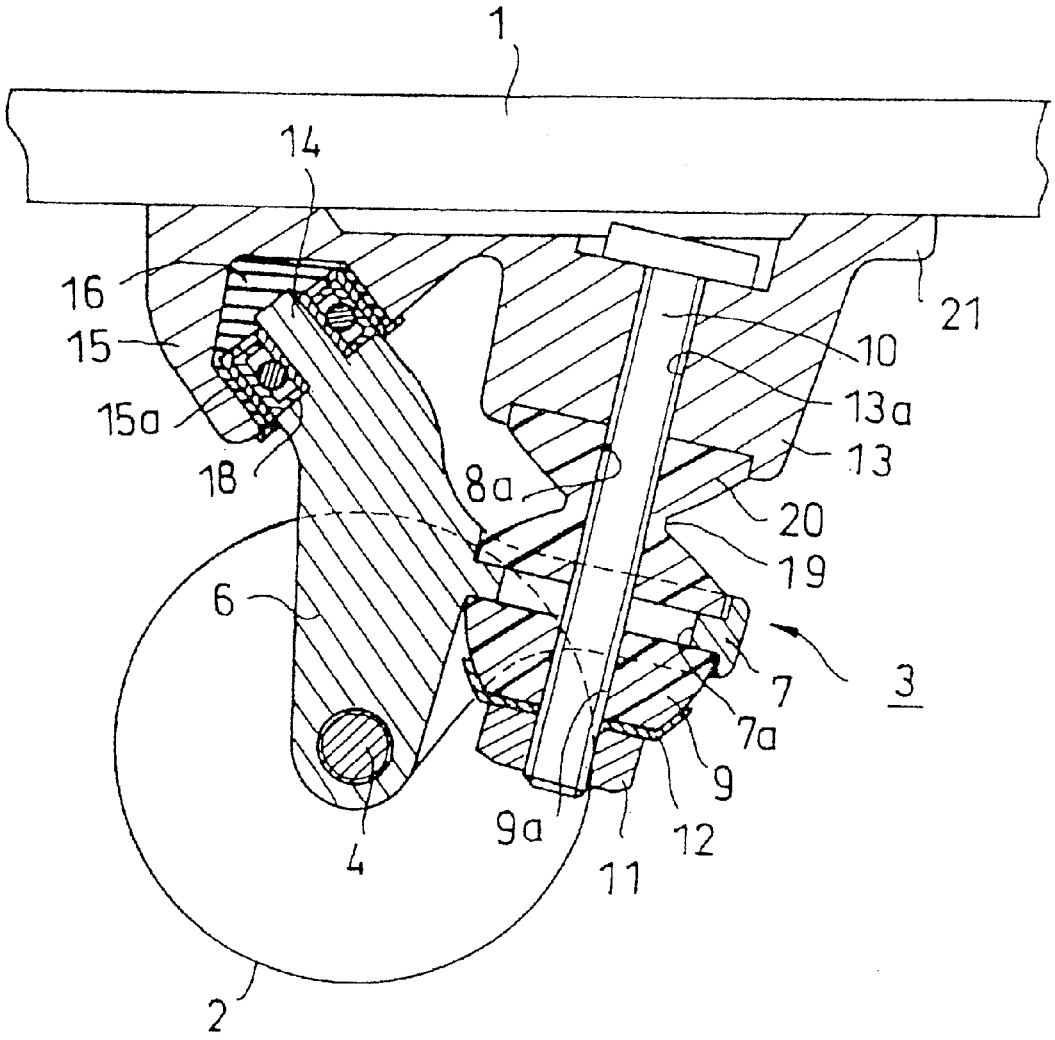
FIG. 1 is a cross-sectional view of the invention.
Figure 2:
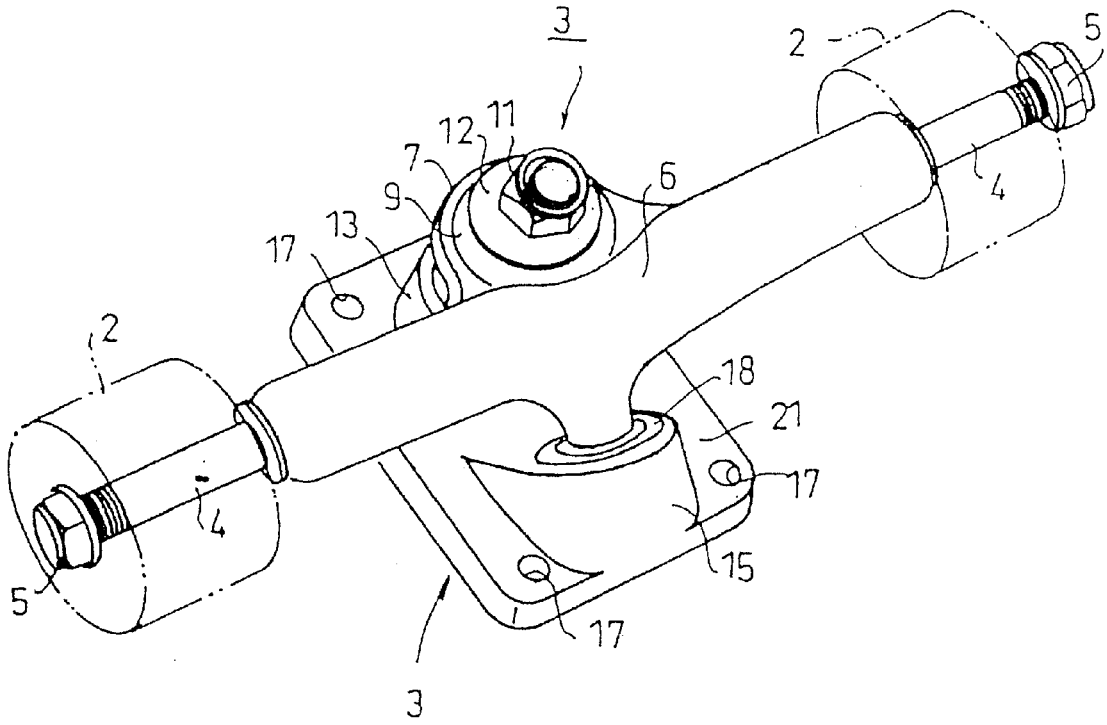
FIG. 2 is an oblique bottom view of the invention.
Figure 3:
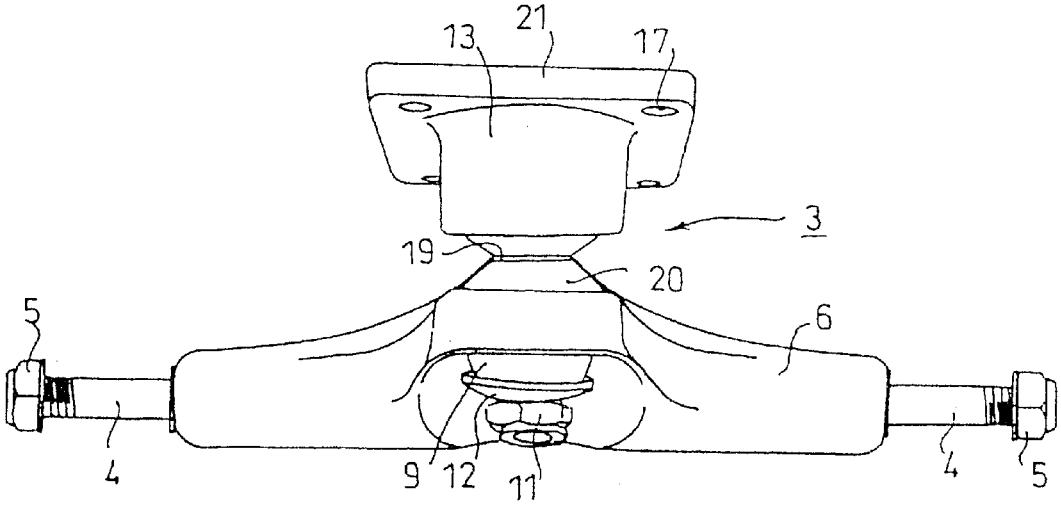
FIG. 3 is a front view of the invention.
Figure 4:
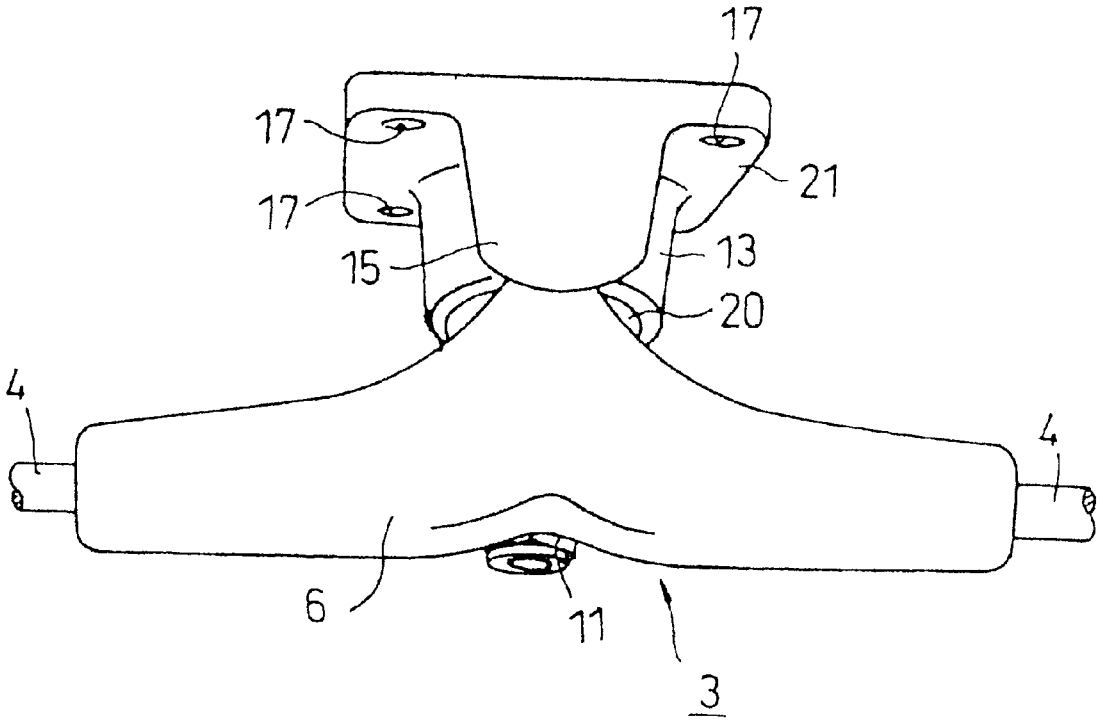
FIG. 4 is a rear view of the invention.
Figure 5:
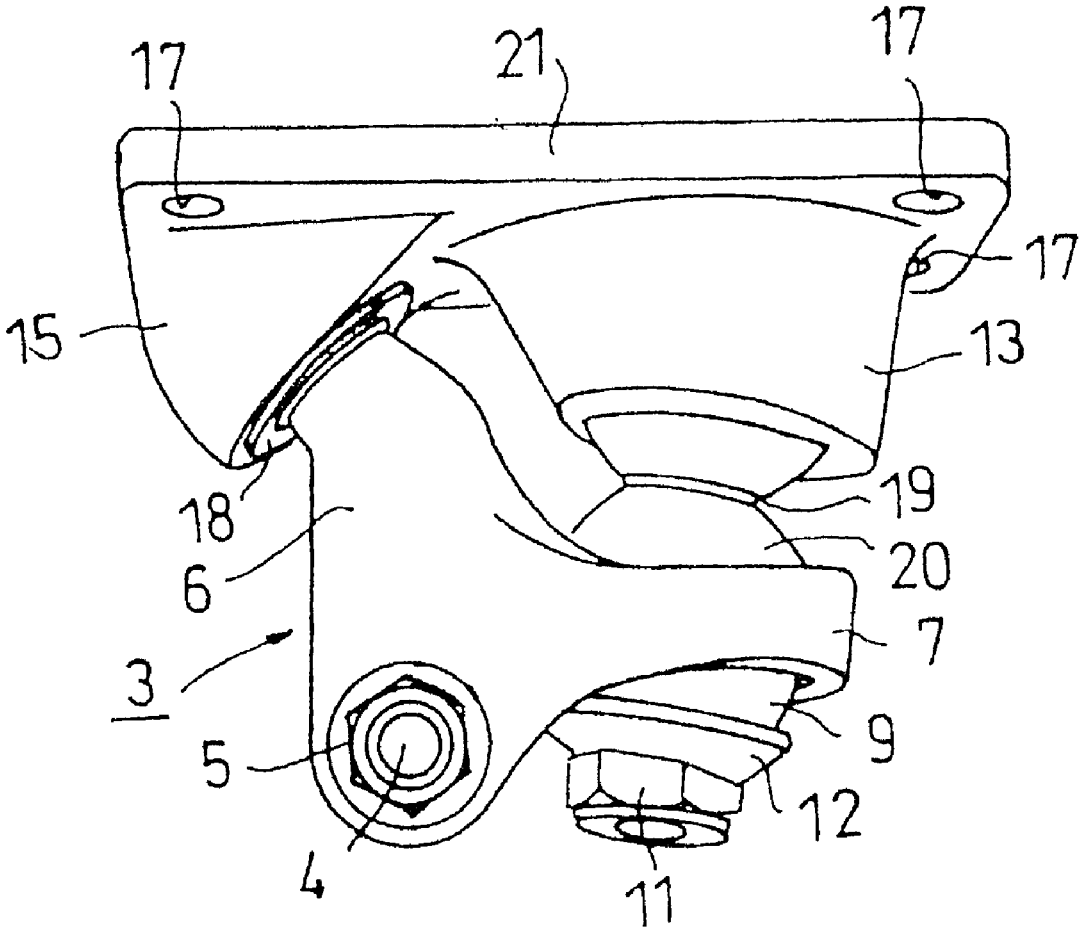
FIG. 5 is a side view of the invention.
Figure 6:
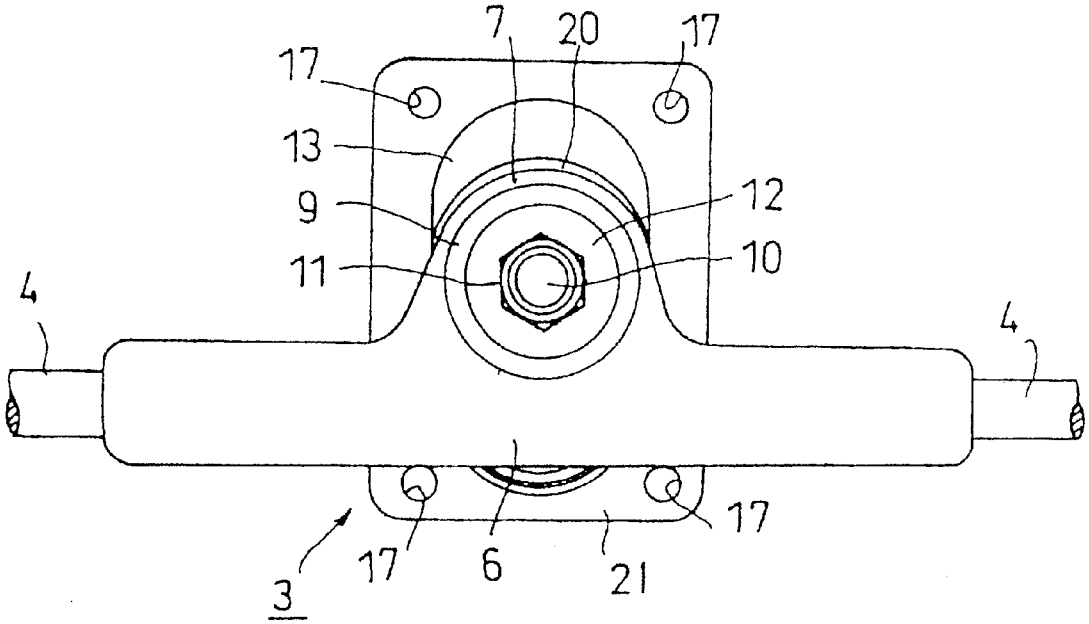
FIG. 6 is a bottom view of the invention.
Figure 7:
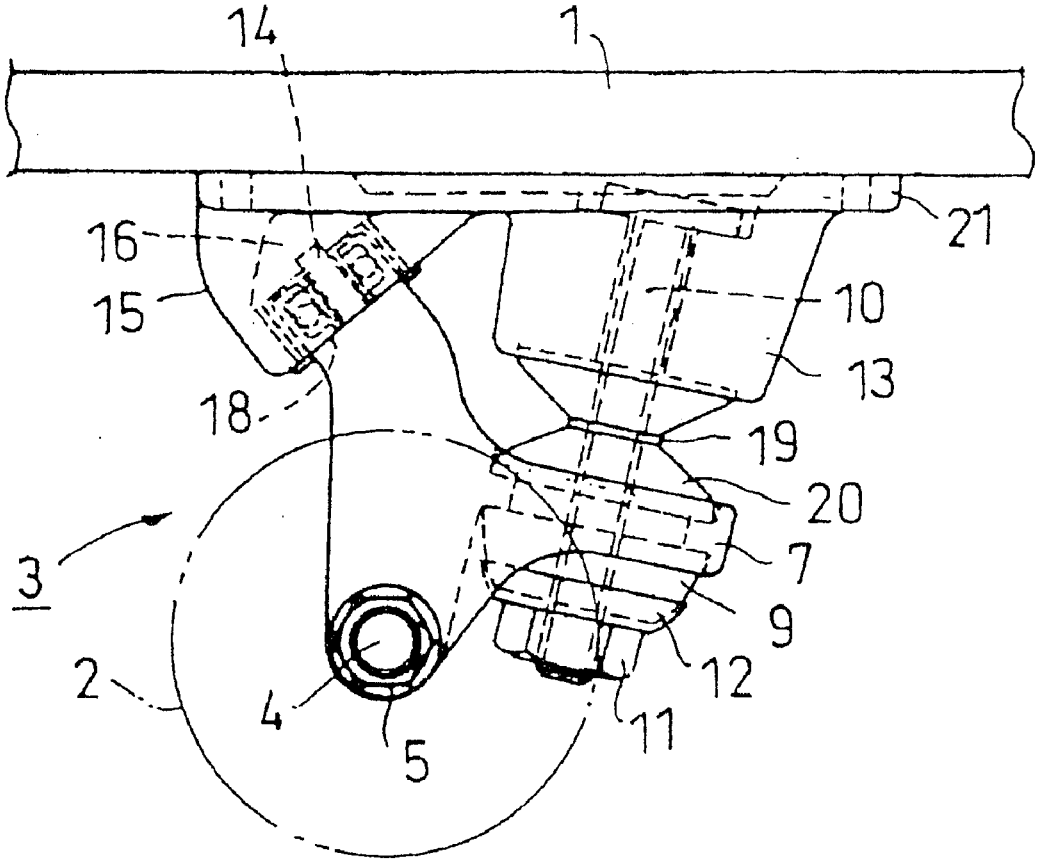
FIG. 7 is a side cross-sectional view of the invention.
Figure 8:
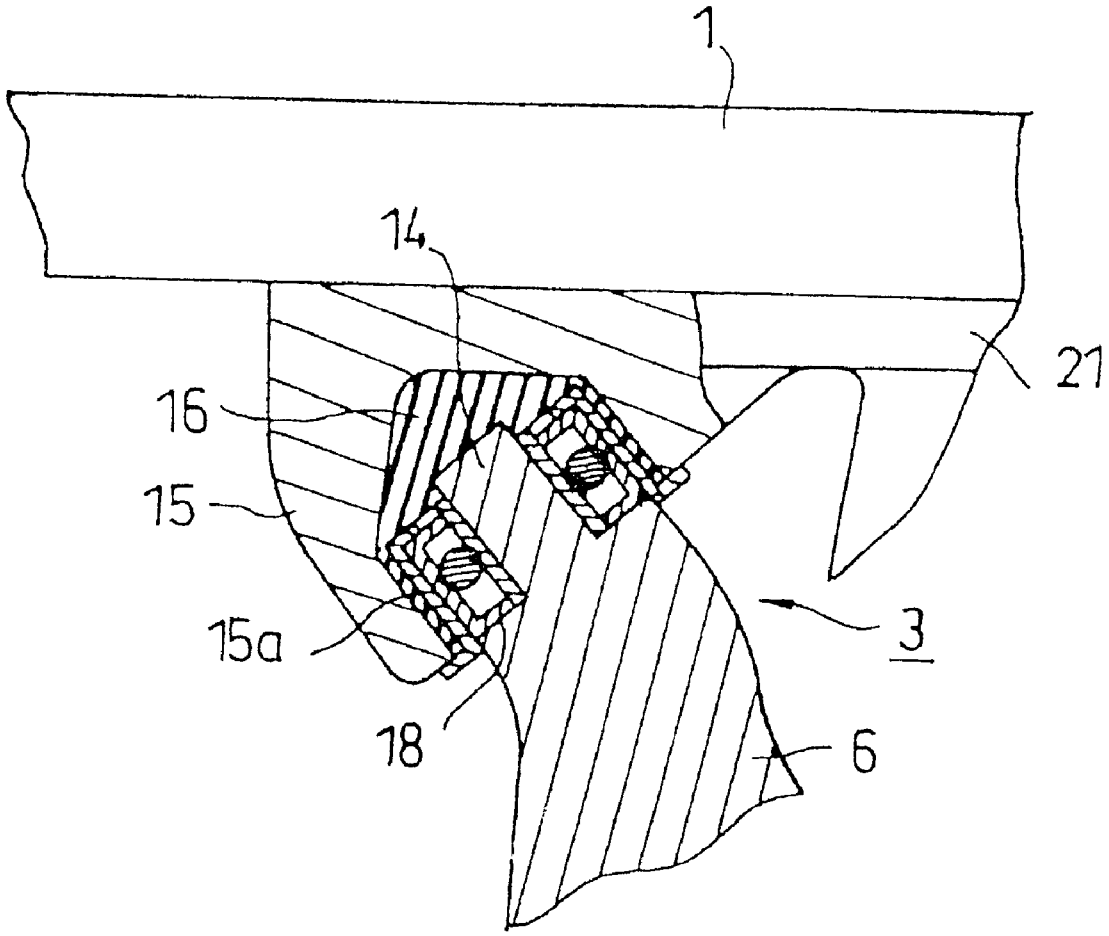
FIG. 8 is a side cross-sectional view of the pivot arm and bearing unit.

Referring now to FIG. 1, a preferred embodiment of the invention is illustrated. A skateboard comprises a board 1 and a set of wheels 2 that are attached to a bottom surface of the board 1. The wheels 2 are attached to the board using trucks 3. A truck 3 is mounted to the bottom surface of the board 1 by a mounting base 21 for example of aluminum or other appropriate metal that comprises a socket hub 15 and a bracket 13. Referring to FIGS. 2–8, the mounting base 21 is preferably mounted to the board 1 by bolts and nuts at mounting holes 17. The truck 3 comprises a right and left wheel axle 4 that extend perpendicularly to the board 1 and a direction of the skateboard's travel. Each wheel axle 4 is mounted through a yoke 6 and affixed with an axle nut 5.

Referring to FIG. 1, the yoke 6 includes an upper pivot arm 14 that is connected to the mounting base 21 at the socket hub 15. The pivot arm 14 is inserted into a ball bearing unit 18 mounted in a bushing 16, preferably made of urethane rubber. A circular flange about the pivot arm 14 seats an annular ball bearing housing which provides a low frictional rotational movement of the pivot arm 14 and the corresponding yoke 6 in the socket hub 15. The bushing 16 and bearing unit 18 are friction mounted in a pivot hole 15*a* in the socket hub 15.

The pivot arm 14 can rotate freely in the ball bearing unit 18 when the board 1 is inclined to the right or left during maneuvers such as a slalom course. The pivot arm 14 has reduced contact with the bushing 16 and therefore friction is reduced. The ball bearing unit 18 is preferably a ball bearing unit. The bearing unit 18 can also be a socket joint bearing as long as there is no obstructions to the support of the pivot arm 14.

When the pivot arm 14 extending from the upper surface of the yoke 6 rotates, the axles 4 can also rotate to provide steering direction to the skateboard.

The yoke 6 further includes an extended hanger 7 that is flexibly clamped by a first grommet 20 and second grommet 9, preferably an upper grommet 20 and a lower grommet 9. A king bolt 10 passes through the lower grommet 9, the hanger 7 and the upper grommet 20 at the bolt holes 9*a*, 7*a* and 8*a* respectively and into the bracket 13 at bolt hole 13*a*. The king bolt 10 is affixed by a nut 11 and a conical washer 12 and tightens the grommets 20 and 9 to the hanger 7.

To further increase the responsiveness of the truck assembly to steering movements by the rider, it is desirable for the extended hanger 7 to be responsive to control and movement when the rider shifts his weight on the board 1. Accordingly, it has been found desirable to provide greater flexing or movement to the bracket 13 by providing an upper grommet 20 that will facilitate such movement. The grommet 20 can be of a single or double piece construction and preferably has a combined cross-sectional configuration of a reduced center relative to the upper and lower surfaces that contact respectively an indented grommet seat in the lower surface of the bracket 13 and an indented grommet seat in the upper surface of the hanger 7.

Figure 10:
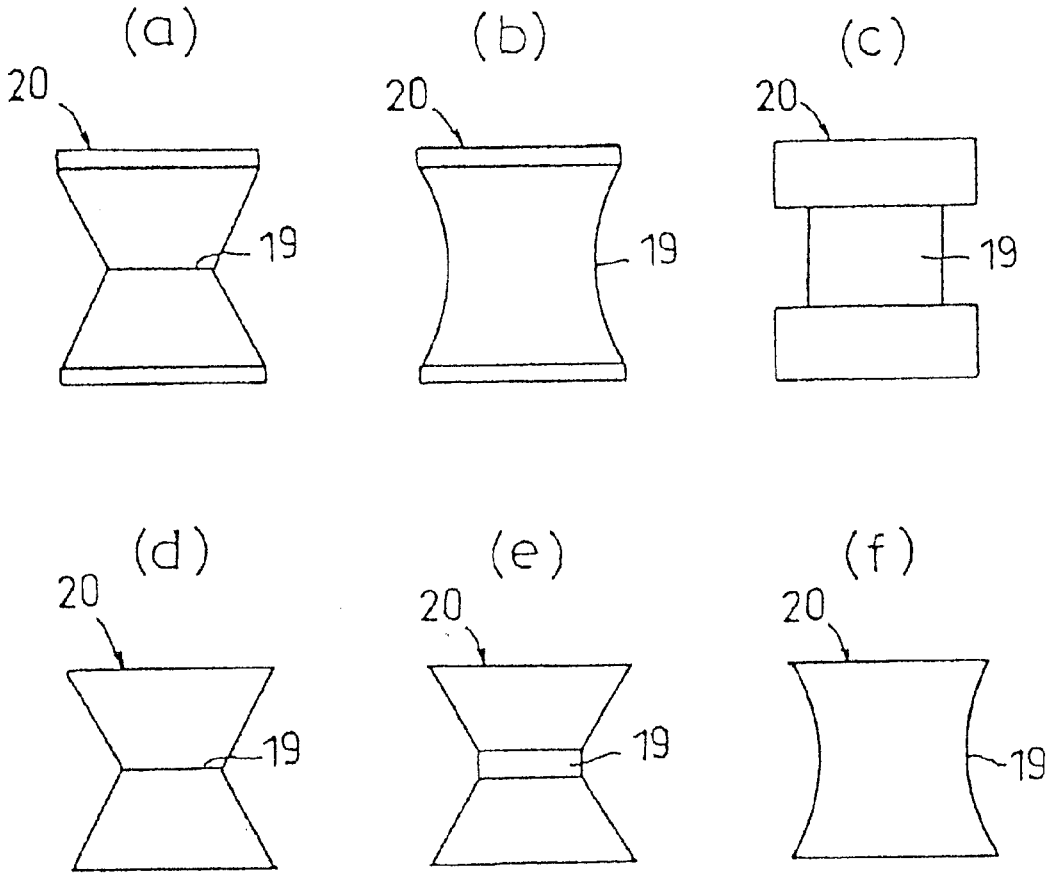
FIGS. 10(*a*)–(*f*) are front views of alternative embodiments of the upper grommet.
Figure 11:
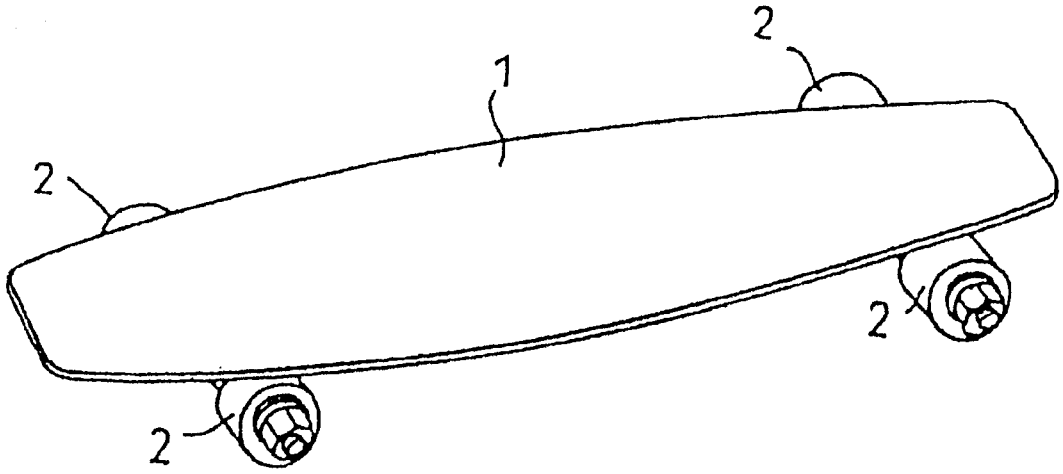
FIGURE 11 PRIOR ART
FIG. 11 is an oblique view of a prior art skateboard.
Figure 12:
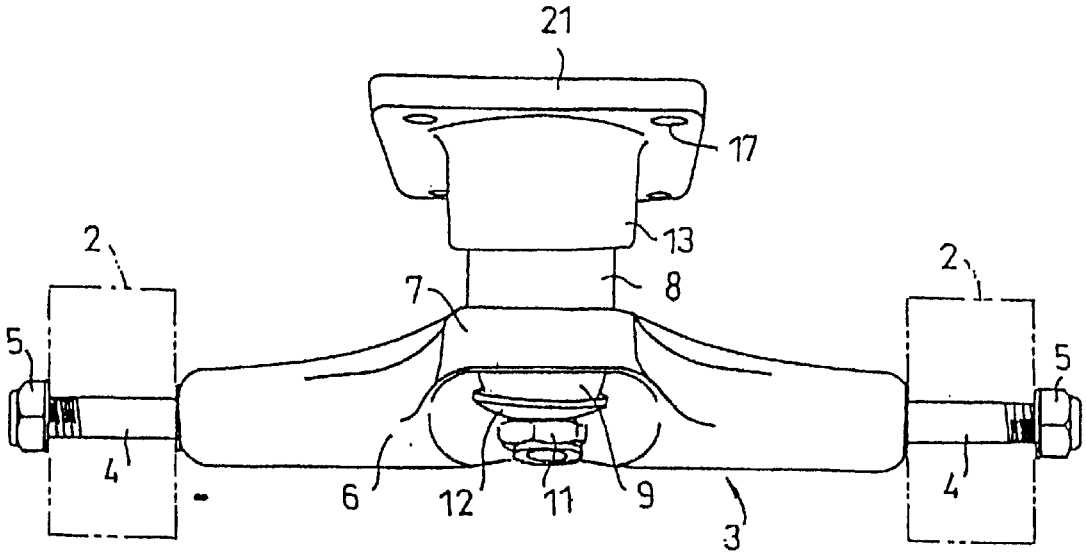
FIGURE 12 PRIOR ART
FIG. 12 is a front view of a prior art truck.
Figure 13:
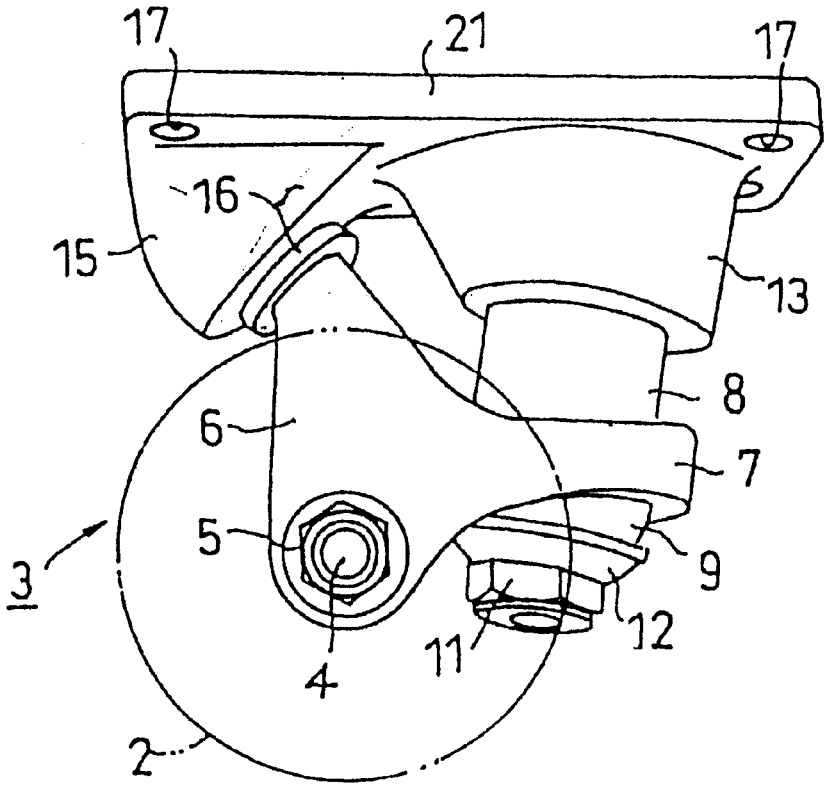
FIGURE 13 PRIOR ART
FIG. 13 is a side view of the prior art truck.
Figure 14:
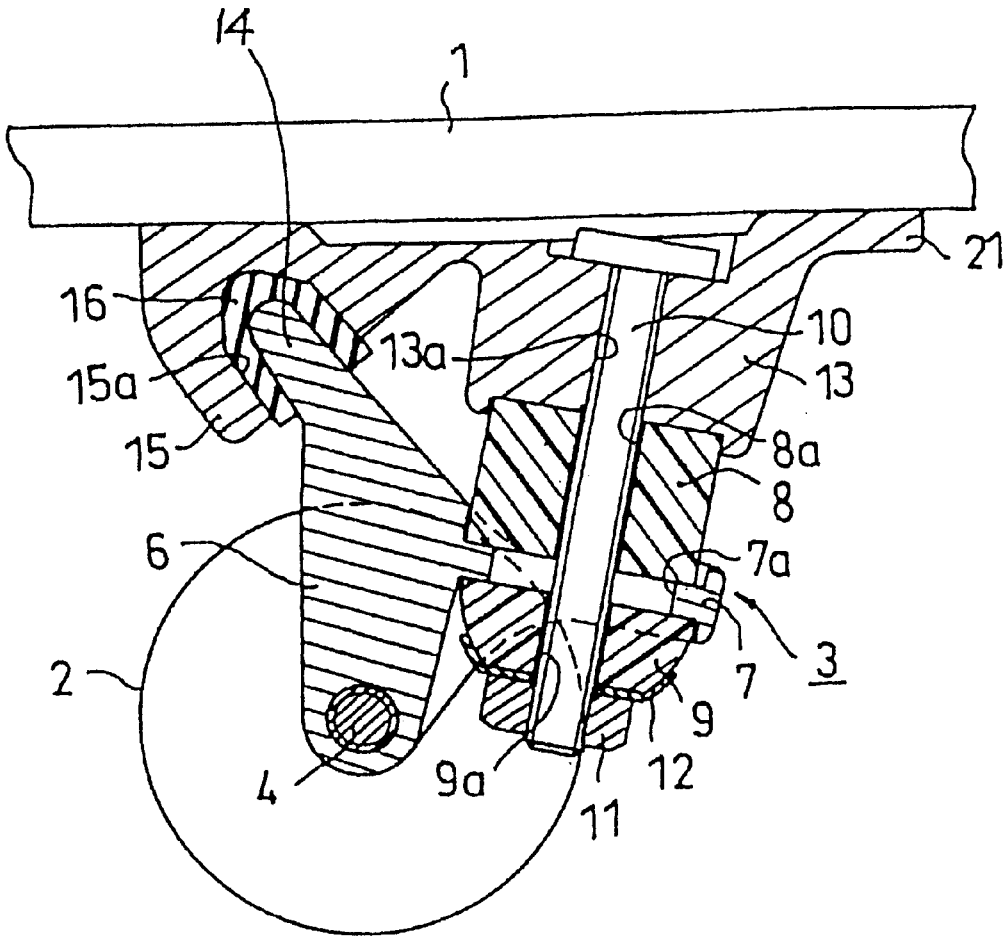
FIGURE 14 PRIOR ART
FIG. 14 is an expanded cross-sectional view of a prior art truck with a skateboard attached.

Preferably, the upper grommet 20 is pulley-shaped. The upper grommet 20 comprises a center circumference or constriction 19. The constriction 19 can also be described as a forming a V-shaped groove around the central circumference of the upper grommet 20. Preferably, the center circumference 19 is narrower than the upper and lower surface edges of the upper grommet 20. The upper grommet 20 does not have to be pulley-shaped. Referring to FIG. 10, six alternative preferred embodiments of upper grommets 20 comprising reduced center circumferences 19 are shown. Additionally, the upper grommet 20 can be a pair of sub-grommet parts each having a semi-spherical configuration.

Figure 9:
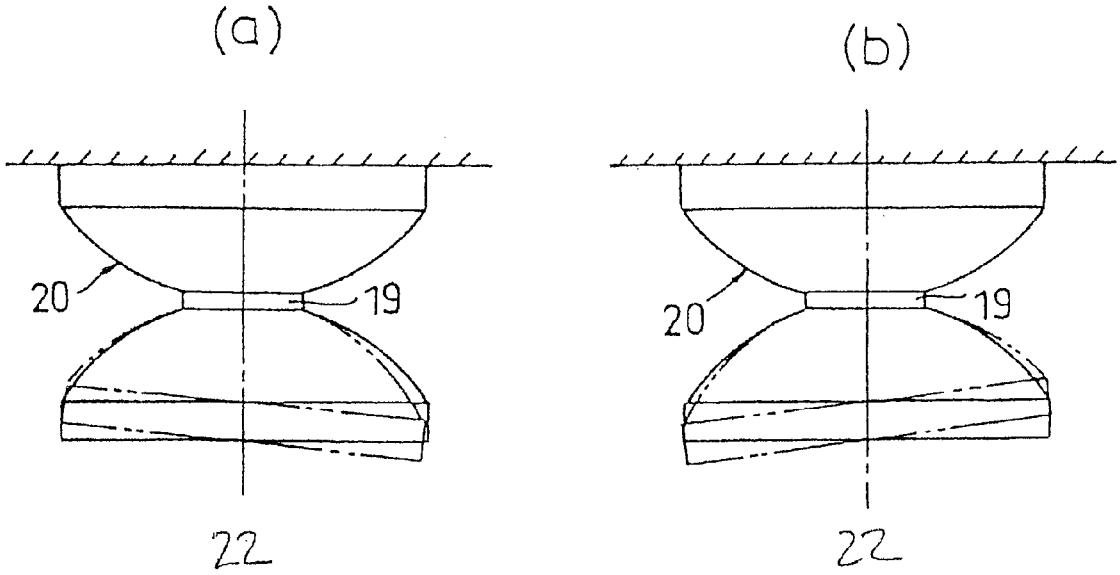
FIG. 9*a* is a front view of a preferred embodiment of the upper grommet inclined to the right.
FIG. 9*b* is a front view of a preferred embodiment of the upper grommet inclined to the left.

Preferably, the upper grommet 20 and the lower grommet 9 are flexible and made of urethane rubber. Referring to FIGS. 9(*a*) and (*b*), another alternative embodiment of the upper grommet 20 is shown. The upper grommet 20 resists compression along an axis 22. However, the upper grommet 20 can turn easily right or left about the center circumference 19 as shown.

Alternatively, the constriction 19 does not have to be located at the center of the upper grommet 20. Instead, the constriction 19 can be located closer to one of the upper or lower edge circumferences as long as skateboard maneuverability is maintained.

The upper grommet 20 in addition to the bearing unit 18 allow the skateboard 1 to maintain vertical stability and flexibility while also allowing the board 1 to quickly and easily change direction during maneuvers such as slalom-riding. This improved skateboard truck also reduces or eliminates possible interruption of rotation of the wheel axis 4.

Preferably, the upper grommet 20 and the lower grommet 9 are treated with a fluorescent coating or doping to emit fluorescent light. The fluorescent substance can also be added to material from which the grommets are made, extruded or molded prior to formation. The fluorescent light should be bright enough to be seen by others at night while the skateboard 1 is being ridden. This feature provides added safety for riders and is an aesthetic feature as well.

The upper grommet 20 is preferably a single body construction. However, as noted above, the upper grommet 20 can also consist of two pieces that join at the center circumference 19 and are held together on the king bolt 10 between the hanger 7 and the bracket 13.

Figure 15:
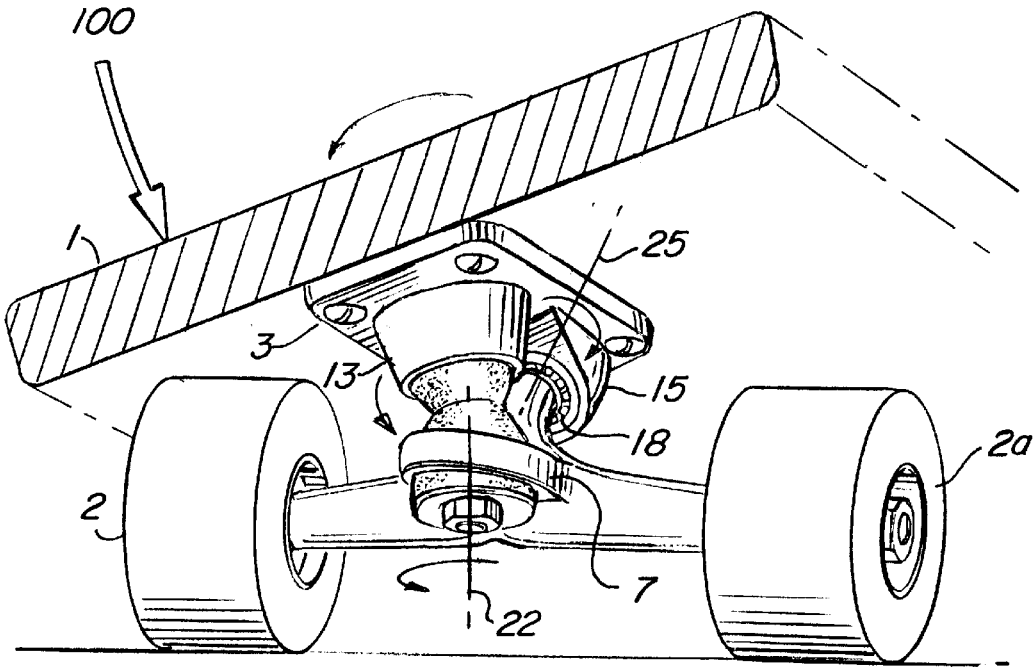
FIG. 15 is a perspective view and diagram of a preferred embodiment of the invention in operation.

Referring now to FIG. 15, a preferred embodiment of the invention is shown in action. Reference numeral 100 refers to the inclining force applied by a user to turn the skateboard 1. The user inclines the skateboard 1 by applying a force 100 to one side of the board 1. The flexible upper grommet 20 inclines about the center circumference 19. The constriction or center circumference 19 of the flexible upper grommet 20 allows the board 1, socket hub 15 and bracket 13 to more quickly and easily incline with the force 100.

The inclination of the board 1, socket hub 15 and bracket 13 places increased pressure on the wheel 2 beneath the force 100. The wheel 2 beneath the force 100 therefore turns slower than the outer wheel 2*a* and the skateboard 1 turns toward the force 100 about the axis 22 through the hanger 7 and upper grommet 20. During the turn, the pivot arm 14 rotates in the ball bearing unit 18 around a pivot arm axis 25 within the socket hub 15. The ball bearing unit 18 allows the pivot arm 14 to more freely rotate and thus allows the truck 3 and wheel 2 assembly to more quickly and freely turn the skateboard 1.

Therefore, the present invention has several advantages over the prior art. The improved skateboard truck reduces friction between the pivot arm 14 and the bushing 16. The improved skateboard truck allows the board 1 to quickly and easily change direction during maneuvers such as slalom-riding. This invention also reduces or eliminates possible interruption of rotation of wheel axis 4 when the board 1 is inclined to the right or left. Thus, turns are smoother and operating performance is increased.

In each of the above embodiments, the different positions and structures of the present invention are described separately in each of the embodiments. However, it is the full intention of the inventor of the present invention that the separate aspects of each embodiment described herein may be combined with the other embodiments described herein. Those skilled in the art will appreciate that adaptations and modifications of the just-described preferred embodiment can be configured without departing from the scope and spirit of the invention. Therefore, it is to be understood that, within the scope of the appended claims, the invention may be practiced other than as specifically described herein.

REFERENCE NUMBERS

1. Skateboard
2. Wheel

2*a*. Outer Wheel
3. Truck
4. Wheel Axle
5. Axle Nut
6. Yoke
7. Hanger
7*a*. Bolt Hole
8. Prior art grommet
8*a*. Bolt Hole
9. Lower grommet
9*a*. Bolt Hole
10. King bolt
11. Nut
12. Washer
13. Bracket
13*a*. Bolt Hole
14. Pivot arm
15. Socket hub
15*a*. Pivot Hole
16. Bush
17. Mounting Hole
18. Bearing unit or Ball Bearing Unit
19. Constriction or Center Circumference
20. Upper grommet
21. Mounting Base
22. Axis
25. Pivot Arm Axis
100. Inclining Force

What is claimed is:

1. An improved skateboard truck comprising:

a mounting base comprising a pivot hole, and a yoke comprising at least one wheel axle, a pivot arm, and a hanger, said hanger clamped by an upper and lower elastic grommet and a king bolt;

said upper elastic grommet comprising an interior segment disposed between two exterior segments wherein the interior segment has a circumference narrower than the circumference of each exterior segment;

said yoke mounted to the mounting base resiliently and fixedly at the hanger by the king bolt, and the pivot arm inserted into a bearing unit and contacting a rubber urethane bush in the pivot hole.

2. The improved skateboard truck of claim 1 where the upper and lower elastic grommet are fluorescent.

3. An improved skateboard truck comprising a yoke mounted by a king bolt to a mounting base comprising a socket hub and a bracket; the yoke comprising a hanger and a pivot arm; the pivot arm supported in the socket hub by a bearing unit; the king bolt clamping the hanger with a first grommet and second grommet; the first grommet comprising an interior circumference disposed between two edge circumferences, wherein the interior circumference is narrower than both edge circumferences.

4. The improved skateboard truck of claim 3 wherein the first grommet is fluorescent.

5. The improved skateboard truck of claim 3 wherein the second grommet is fluorescent.

6. The improved skateboard truck of claim 3 wherein the socket hub comprises a flexible bushing.

7. The improved skateboard truck of claim 3 wherein the first grommet is flexible.

8. The improved skateboard truck of claim 7 wherein the first grommet is urethane rubber.

9. The improved skateboard truck of claim 3 wherein the pivot arm rotates freely in the bearing unit.

10. A skateboard comprising a board, at least two wheels and at least one improved skateboard truck; the skateboard truck comprising a yoke mounted by a king bolt to a mounting base comprising a socket hub and a bracket; the yoke comprising a hanger and a pivot arm; the pivot arm rotates freely in a bearing unit supporting the pivot arm in the socket hub; the king bolt clamping the hanger with a first grommet and a second grommet; the first grommet is flexible and comprises a center circumference disposed between two edge circumferences wherein the center circumference is smaller than both edge circumferences.

11. The skateboard of claim 10 wherein the first and second grommets are fluorescent.

12. The skateboard of claim 10 wherein the socket hub further comprises a flexible bushing.

13. The skateboard of claim 10 wherein the second grommet is flexible.

14. The skateboard of claim 10 wherein the first and second grommets are made of urethane rubber.

15. An improved skateboard truck comprising a yoke mounted by a king bolt to a mounting base comprising a socket hub and a bracket; the yoke comprising a hanger and a pivot arm; the pivot arm inserted in the socket hub; the king bolt clamping the hanger with a first grommet and a second grommet; the first grommet comprising an interior circumference disposed between two edge circumferences wherein the interior circumference is narrower than the two edge circumferences.

16. The improved skateboard truck of claim 15 wherein the first and second grommets are fluorescent.

17. The improved skateboard truck of claim 15 wherein the first grommet is flexible.

18. An improved skateboard truck comprising:

a yoke mounted by a bolt to a mounting base comprising a socket and a bracket;

the yoke comprising a hanger and a pivot arm;

the pivot arm inserted in the socket;

the bolt supporting the hanger and a grommet;

the grommet comprising an interior circumference disposed between two edge circumferences wherein the interior circumference is narrower than the two edge circumferences.

19. The improved skateboard truck of claim 18 where the socket further comprises a bearing unit; where the pivot arm is inserted in the bearing unit in the socket.

20. The improved skateboard truck of claim 19 where the socket further comprising a flexible bushing; where the pivot arm passes through the bearing unit and an end of the pivot arm contacts the bushing in the socket.

21. An improved skateboard truck comprising:

a hanger interposed between a first grommet and a second grommet;

said first grommet having an interior circumference disposed between two edge circumferences wherein the interior circumference is smaller than the two edge circumferences.

22. The improved skateboard truck of claim 21 where the grommet is fluorescent.

* * * * *